United States Patent [19]

Helinski et al.

[11] Patent Number: 4,603,985

[45] Date of Patent: Aug. 5, 1986

[54] BACKSTOP AND DAMPING APPARATUS FOR ACTUATOR

[75] Inventors: Edward F. Helinski, Johnson City; Ho C. Lee, Endicott, both of N.Y.

[73] Assignee: International Business Machines Corporation, Armonk, N.Y.

[21] Appl. No.: 622,827

[22] Filed: Jun. 21, 1984

[51] Int. Cl.[4] ..... B41J 9/42

[52] U.S. Cl. ..... 400/167; 101/93.02; 408/143; 188/378

[58] Field of Search ..... 101/93.02, 93.48, 93.03, 101/93.29; 400/157.1, 157.2, 157.3, 166, 167; 188/378, 379, 380; 408/143

[56] References Cited

U.S. PATENT DOCUMENTS

| | | | |
|---|---|---|---|
| 3,418,928 | 12/1968 | Ponzano | 101/93.02 |
| 3,426,675 | 2/1969 | Dalton | 101/93.02 X |
| 3,572,112 | 3/1971 | Igoe | 188/380 X |
| 3,749,008 | 7/1973 | Carlson et al. | 400/157.2 X |
| 3,946,976 | 3/1976 | Radford | 188/379 X |
| 4,064,799 | 12/1977 | Babler | 400/166 X |
| 4,203,554 | 5/1980 | Zimmer et al. | 267/160 X |
| 4,322,063 | 3/1982 | Fischbeck et al. | 188/380 X |
| 4,332,489 | 6/1982 | Dollenmayer | 400/166 X |

FOREIGN PATENT DOCUMENTS

| | | | |
|---|---|---|---|
| 28878 | 3/1981 | Japan | 101/93.02 |
| 61588 | 4/1982 | Japan | 101/93.48 |
| 160673 | 10/1982 | Japan | 400/157.1 |
| 96580 | 6/1983 | Japan | 101/93.48 |
| 112757 | 7/1983 | Japan | 400/166 |

OTHER PUBLICATIONS

Xerox Disclosure Journal, "Multi-Impact Backstop for Print Hammer", Mitrovich S., vol. 1, No. 4, Apr. 1976, p. 21.

*Primary Examiner*—Paul T. Sewell
*Assistant Examiner*—James R. McDaniel
*Attorney, Agent, or Firm*—John S. Gasper; Kenneth P. Johnson

[57] ABSTRACT

Damping apparatus within an actuator device in which a backstop is supported on one portion of a dual cantilever to match the movement of the impacting actuator to reduce wear and provide positive restoration of initial position, wherein the backstop-supporting cantilever portion is embedded in energy-absorbing elastomeric material that is symmetrically confined to shorten settling time of the actuator and remain unaffected by temperature changes.

7 Claims, 7 Drawing Figures

BACKSTOP AND DAMPING APPARATUS FOR ACTUATOR

BACKGROUND OF THE INVENTION

This invention relates generally to print hammer actuators, and more particularly, to apparatus by which rebounding motion of a print hammer or actuator is efficiently and quickly damped without degrading the rest portion so as to carefully control flight time.

One of the limitations in achieving faster printing rates in high speed impact printers has been the settling time required by the print hammer or actuator before its next energization. Settling is required to accurately attain a position from which the actuator starts. If the actuator or hammer is not in its expected at-rest position, the flight time differs from the design dimensions and the time of hammer impact varies with respect to the moving type element. Misregistration of printing then occurs.

A backstop or bumper is provided against which the actuator can come to rest after being released from energization that is usually electromagnetic. In commercially available printing, the backstop is frequently an adjustable surface that is used to prevent wear and reduce noise while providing mediocre energy-absorbing qualities. A typical material used as a bumper is polyurethane. This will relatively slowly absorb and decrease the kinetic energy in the actuator compared to high damping materials such as butyl rubber.

The actuator rest position and flight time can tend to change with use. The backstop surface can wear and the energy-absorbing material can slowly cold flow or take a "set" in response to the repetitive pounding that it receives. The wear usually occurs because of relative movement between the backstop and actuator at the point of impact. This motion, even though a small amount, causes eventually change in the at-rest position of the actuator and results in longer flight times in the mechanisms. When the energy-absorbing material takes a set, its spring rate and damping chacteristics will be altered and further travel of the actuator will result. Also, changes in temperature cause expansion or contraction of the bumper material resulting in changes in rest position that affects flight time. In either instance adjustment or replacement is necessary and the large number of parallel hammer assemblies in each unit make corrective action costly and time consuming.

OBJECT AND SUMMARY OF THE INVENTION

It is accordingly, a primary object of this invention to provide backstop apparatus for an actuator which radically reduces or eliminates relative motion and thereby reduces wear between a restoring actuator and its backstop.

Another important object of this invention is to provide an actuator backstop having support apparatus with compensating components of motion adaptable to the components of motion of the striking actuator to thereby practically eliminate any relative motion and wear between backstop and actuator.

Yet another important object of this invention is to provide backstop apparatus for an actuator that incorporates as an effective damping element material having highly efficient energy absorption characteristics but low resistance to compression set and arranged to have improved thermal insensitivity to thereby achieve shorter settling time.

The foregoing objects are attained in accordance with the invention by providing an actuator backstop means mounted on supporting dual or folded cantilever means with the cantilever means having a free end embedded in energy absorbing and damping material having minimal set resistance. Dual cantilever means enables the achievement of components of motion when impacted that will be similar to and closely match the components of movement of the striking actuator. Because of this, relative movement is practically non-existent between the backstop and actuator and wear is extremely slow at the impact surfaces. The low compression set of the damping material is compensated for by the cantilever return beams. Partial containment of the damping material permits the stabilization of the material during temperature canges so that the cantilever means maintains constant or controlled position and resistance to motion during operation.

The foregoing and other objects, features an advantages of the invention will be apparent from the following more particular description of the preferred embodiment of the invention as illustrated in the accompanying drawing.

DESCRIPTION OF THE PREFERRED EMBODIMENTS

Figure 1:
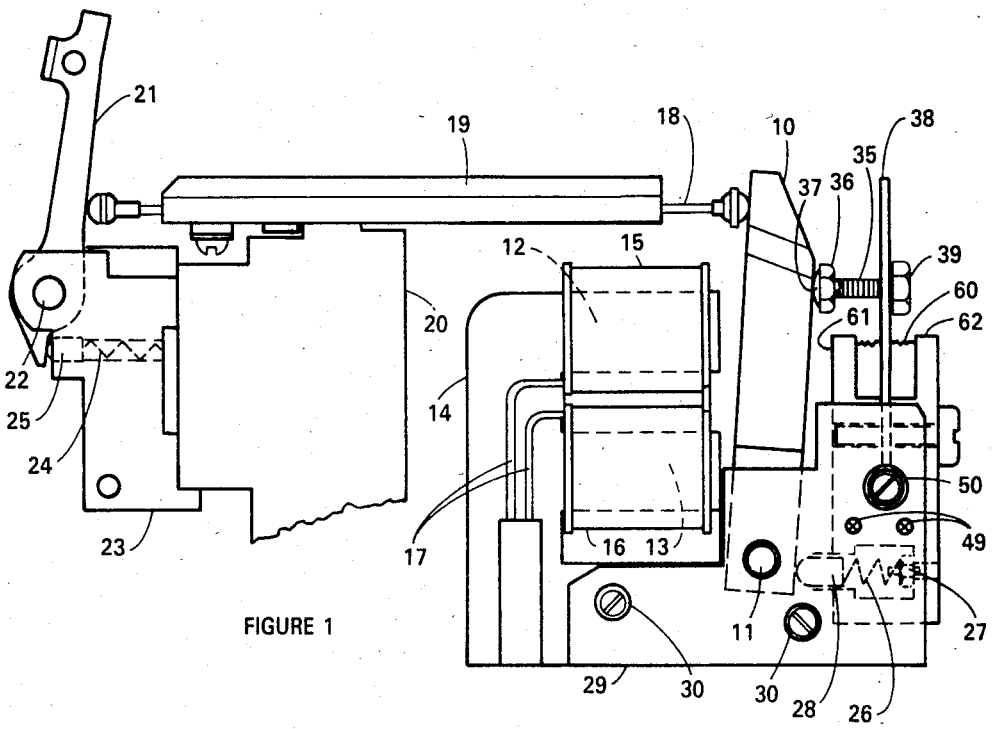
FIG. 1 is an elevation view of a print hammer mechanism incorporating a backstop apparatus constructed in accordance with the principles of the invention.

Referring to FIG. 1, a print hammer mechanism is shown for a single print position of a high speed printer. The mechanism includes an armature 10, electromagnetically attracted about pivot 11 to poles 2, 13 of stationary magnetic core 14 when coils 15, 16 are energized by drive pulses through wires 17 from a source, not shown. The energy induced in armature 10 engages push rod 18 which moves within guide 19 on machine frame 20 and impacts print hammer 21 driving it about by pivot 22 against an inked ribbon, paper and type band, not shown. Hammer 21 is supported by pivot 22 and mounting block 23 on machine frame 20. The print hammer and push rod are urged to the retracted at-rest position, as shown, by spring 24 and plunger 25. Armature 10, serving as an actuating element, is also urged to its retracted position, as shown, by spring 26 supported on retainer 27 urging plunger 28 against the armature 10. Pivot pin 11 is supported in a pair of side plates 29 that are joined on opposite sides of stationary core 14 by screws 30.

In its retracted position, armature 10 rests against a stop element or bumper comprising a screw 35 having molded on its head 36 a quantity of an energy-absorbing elastomer 37 engaged by the armature 10. The elastomer may be a typically used, durable material such as polyurethane. Screw 35 threadedly engages a supporting member 38 and is secured therein by a locknut 39. The screw and its bumper 37 are thus adjustable relative to member 38 to accurately establish a rest position for armature 10.

Figure 2:
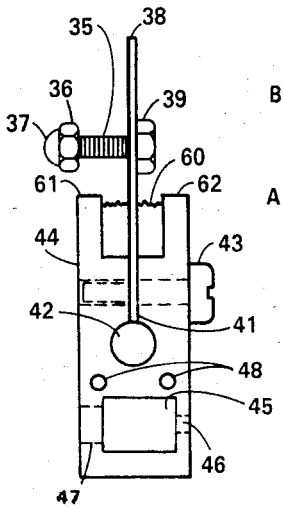
FIG. 2 is an elevation view of the backstop apparatus shown in FIG. 1.
Figure 3:
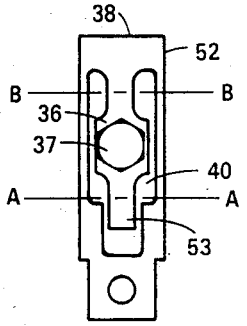
FIG. 3 s an elevation view of the dual cantilever support for the backstop shown in FIG. 2.

As best seen in FIGS. 2 and 3, member 38 comprises a thin, planar piece of material having a cutout 40 to form dual or folded cantilever beams. The cantilever is preferably of metal, such as steel, and of a thickness that allows limited deflection when the stop member 37 is struck by armature 10 while returning to its retracted position. Cantilever 38 is supported in a slot 41 which intersects hole 42 within base 44 and is secured by screw 43 threadedly engaging base 44 at the left side of cantilever 38 with a clearance hole on the right side of cantilever 38 as seen in FIG. 2. Base 44 contains a cutout 45 to accommodate spring 26 shown in FIG. 1 and has holes 46 and 47 to accommodate retainer 27 and plunger 28, respectively. Base 44 also contains two through holes 48 to coincide with openings in side plates 29 in which locating pins 49 can be placed. Screw 50 is also used to clamp the sideplates against base 44.

Cantilever 38 forms two cantilevers and, when clamped in position in base 44, has a first bending axis in the vicinity of line A—A and a second bending axis generally about line B—B. When armature 10 impacts bumper 37, a bending moment occurs about both axes simultaneously with the result that head 36 of screw 35 will move approximately horizontally as viewed in FIG. 2. The upper portion 52 (FIG. 3) of the first cantilever will move clockwise, about axis A—A with respect to base 44, while tongue portion 53, the free end of the second cantilever, will move counterclockwise about axis B—B. By selecting the cross-sectional area of the cantilever sides near line A—A with respect the cross-sectional area of the tongue near axis B—B, the clockwise and counterclockwise bending motion of the two cantilevers can be made in different proportions to thereby achieve the desired motion at bumper 37 when impacted by the actuator. Thus, in the arrangement in FIG. 1, because of the arcuate motion of the armature 10, bumper 37 should move slightly downward at its left end as it is impacted by the armature 10. Because the motion of bumper 37 with respect to base 44 can simulate the path of motion of the armature 10, little or no relative motion occurs along the back edge of the armature 10 where it contacts bumper 37. The vertical motion components can be cancelled or nullified to varying degrees by the amount of bending permitted by the two cantilevers.

The energy transferred to bumper 37 causes deflection of the dual or folded cantilever 38 about respective, approximate bending axis A—A and B—B. This energy is absorbed by end 53 embedded in a body of molded elastomeric material 60, such as butyl rubber 91-11R. This material has a high energy-absorption efficiency that suppresses the cantilever motion and reduces the rebounding of armature 10. Elastomer 60 is molded between walls 61 and 62 of base 44 and is semi-confined in the direction of forces exerted by cantilever tongue 53 during movement.

An increase in damping effectiveness is easily achieved at the expense of creep or compression set of the damping material. Butyl rubber is one of the best known elastomeric damping materials; however, its use as a bumper has been unsatisfactory due to compression set and wear through its short life. Stable damping is achieved with butyl rubber by operating at low stress levels, without a sliding component to cause wear, and by the use of positive restoration to prevent changes in initial position of the bumper. The relatively large area of cantilever tongue 53 reduces the force per unit area on the elastomer and does not produce a sliding component. Hence, the characteristics of the butyl rubber can be used to significant advantage in the disclosed arrangement.

Figure 4A:
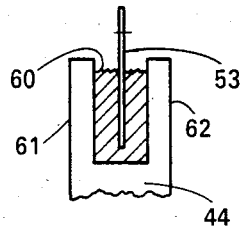
FIGS. 4*a* and 4*b* are sectional views of two comparative embodiments of the energy-absorption damping systems for use with the backstop apparatus.
Figure 4B:
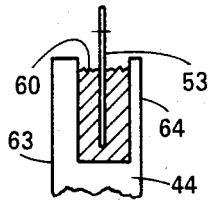

Base walls 61 and 62 can be made to achieve the desired reaction of the elastomer during temperature changes. Referring to FIGS. **4*a* and 4*b*, walls 61 and 62 are illustrated as laterally confining a body 60 of elastomeric material in which cantilever end 53 is embedded. The walls 61 and 62 are relatively thick and unyielding if the temperature of elastomer 60 is assumed to increase. Any expansion of the elastomer will push out the open sides or upwardly but will not produce a displacement of cantilever end 53. In this embodiment, the elastomer arrangement is insensitive to temperature changes. In FIG. 4*b*, a pair of walls 63 and 64 are used to confine elastomer body 60 and cantilever end 53. However, wall 64 is relatively thin and will move to the right during the expansion of elastomer 60. Any dimensional change in the horizontal location of wall 64 will cause approximately half that change in the horizontal location of cantilever end 53 since end 53 is in approximately the middle of the body of elastomer. This latter arrangement can be used to move end 53 to the right slightly to offset the expansion of the urethane bumper 37 on screw 36 in FIGS. 1 and 2**.

Figure 5:
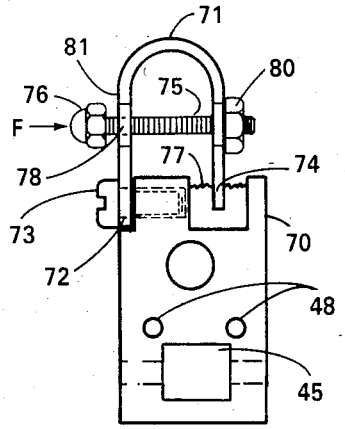
FIGS. 5 and 6 are elevation and side views, respectively, of an alternative embodiment of a dual cantilever backstop apparatus.
Figure 6:
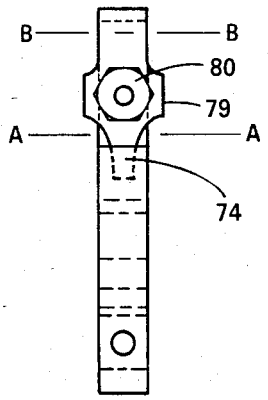

An alternative arrangement of a dual or folded cantilever that can be substituted for the structure shown in FIG. 2 is shown in FIGS. 5 and 6. In this embodiment, base 70 supports a dual cantilever 71 having an inverted U-shape. The fixed end 72 of the first cantilever is attached to base 70 by screw 73. The free end 74 of the second cantilever, supports screw 75 with elastomeric bumper 76, and is embedded in a molded body 77 of an elastomer such as butyl rubber. Impact screw 75 passes through an opening 78 in the first cantilever and is threadedly secured in enlargement 79 adjacent to free end 74 of the second cantilever by locknut 80. As force F impacts bumper 76, motion is transmitted to free end 74 causing it to move counterclockwise about approximate axis B—B while cantilever portion 81 will move clockwise generally about axis A—A which is located above its fixed point at screw 73. These motions can be adapted to counteract each other by choosing material cross-sectional areas to establish a vertical motion component equal to that of the striking member.

While the novel features of the present invention have been shown and described with reference to preferred embodiments thereof, it will be understood by those skilled in the art, that the foregoing and other changes can be made in the form and details without departing from the spirit and scope of the invention.

What is claimed is:

1. An apparatus such as a print hammer having an actuator means including an actuator element moveable to effect operation such as printing, said actuator element having a forward movement and a rebound movement, a base member;

an improved stop mechanism for establishing an at-rest position and for damping the rebound energy of said actuator element comprising, cantilever means comprising a first cantilever beam secured at one end to said base member and having fixedly attached at its free end one end of a second cantilever beam in which said first and second cantilever beams have parallel bending axes relative to said base member and a backstop member supported by said second cantilever beam at a location between said bending axes whereby components of motion of the free ends of said first and second cantilever beams counteract each other to nullify components of motion normal to the direction of motion of said actuator element upon impact with said backstop member by said second cantilever beam, said second cantilever beam extending generally parallel with said first cantilever beam and towards said secured end and the backstop carried by the free end of the second cantilever beam lying in the path of motion of said actuator element to be impacted by said actuator element on rebound, and a damping material secured by said base member with the free end of said second cantilever beam embedded in said dampening material to limit the movement of said free end of said second cantilever beam.

2. Apparatus as described in claim 1 wherein said first and second cantilever beams lie in substantially the same plane.

3. Apparatus as described in claim 1 wherein said first and second cantilever beams are joined in a U-shape.

4. Apparatus as described in claim 1 wherein said damping material is confined in a cavity in said base member, said cavity having side walls bounding said damping material on opposite sides of said embedded free end of said second cantilever beam along the direction of motion thereof, and said cavity having an opening between said side walls for allowing thermal expansion and contraction of said damping material in a direction transverse to said direction of motion of said free end of said second cantilever beam so as to have negligible effect on the at-rest position of said free end of said second cantilever beam during temperature changes of said material.

5. Apparatus as described in claim 4 wherein said side walls bounding said damping material are of unequal thickness, said one wall being sufficiently thin to be moved by thermal expansion of said material in the direction away from the other of said wide walls and in said direction of motion of said free end of said cantilever beam embedded in said damping material.

6. Apparatus as described in claim 1 in which said damping material is an elastomer such as butyl rubber.

7. Apparatus as described in claim 6 in which said elastomer damping material is semi-confined in the direction of forces exerted by said second cantilever beam.

* * * * *